US005251989A

United States Patent [19]

Di Luco

[11] Patent Number: 5,251,989

[45] Date of Patent: Oct. 12, 1993

[54] APPARATUS FOR MAKING A MULTI-COLORED PRINTING RIBBON

[76] Inventor: Eugene Di Luco, 1760 Miriam St., North Brunswick, N.J. 08902

[21] Appl. No.: 927,461

[22] Filed: Aug. 10, 1992

[51] Int. Cl.[5] ..... B41J 31/09

[52] U.S. Cl. ..... 400/240.3; 118/211; 118/216; 118/221; 118/223; 118/224; 118/235; 118/244

[58] Field of Search ..... 400/237, 201, 240.3, 400/240.4, 241.3; 118/77, 106, 118, 123, 209, 211, 216, 217, 221, 222, 223, 224, 234, 235, 244–245, 247–251, 255, 258, 263, DIG. 15, 672, 200, 227

[56] References Cited

U.S. PATENT DOCUMENTS

| | | | |
|---|---|---|---|
| 349,026 | 9/1886 | Anderson | 400/240.4 |
| 776,515 | 12/1904 | Ives . | |
| 810,629 | 1/1906 | Dix | 118/258 |
| 1,144,742 | 6/1915 | Todd et al. . | |
| 1,428,278 | 9/1922 | Dow . | |
| 2,104,237 | 1/1938 | Neidich | 118/211 |
| 2,128,098 | 8/1938 | Mannino | 118/211 |
| 2,300,787 | 11/1942 | Ingliss . | |
| 3,048,697 | 8/1962 | Cavanaugh et al. . | |
| 3,274,039 | 9/1966 | Ploeger, Jr. | 400/240.4 |
| 3,332,827 | 7/1967 | Griffith et al. . | |
| 3,434,456 | 3/1969 | Geating | 118/211 |
| 3,578,136 | 5/1971 | Postal . | |
| 3,716,125 | 2/1973 | Ploeger, Jr. et al. | 400/240.3 |
| 3,858,705 | 1/1975 | Retiano . | |
| 3,861,305 | 1/1975 | Sasaki . | |
| 3,983,840 | 10/1976 | Francis | 118/235 |
| 4,009,892 | 3/1977 | Nickerson . | |
| 4,175,776 | 11/1979 | Ranauro . | |
| 4,188,139 | 2/1980 | Pasini et al. . | |
| 4,234,214 | 11/1980 | Lee . | |
| 4,277,514 | 7/1981 | Sugiura et al. . | |
| 4,503,095 | 3/1985 | Seto et al. | 400/240.4 |
| 4,511,616 | 4/1985 | Pitts et al. . | |
| 4,523,777 | 6/1985 | Holbein et al. . | |
| 4,577,983 | 3/1986 | Aviram et al. | 400/201 |
| 4,636,844 | 1/1987 | Sasaki . | |
| 4,668,597 | 5/1987 | Merchant . | |
| 4,689,018 | 8/1987 | Trinity . | |
| 4,797,016 | 1/1989 | Lahr . | |
| 4,957,312 | 9/1990 | Morello . | |
| 4,984,912 | 1/1991 | Findlay et al. | 400/240 |

FOREIGN PATENT DOCUMENTS

| | | | |
|---|---|---|---|
| 581644 | 9/1958 | Italy | 118/258 |
| 0045072 | 3/1982 | Japan | 400/201 |
| 58-89327 | 5/1983 | Japan . | |
| 0101376 | 6/1984 | Japan | 400/240.4 |
| 0064867 | 4/1985 | Japan | 400/240.4 |
| 0096473 | 5/1985 | Japan | 400/240.3 |
| 0079692 | 4/1986 | Japan | 400/201 |
| 1-154799 | 1/1989 | Japan . | |
| 466871 | 9/1934 | United Kingdom | 118/211 |
| 323936 | 2/1936 | United Kingdom . | |
| 440835 | 2/1936 | United Kingdom . | |
| 2119714 | 11/1983 | United Kingdom | 118/258 |

OTHER PUBLICATIONS

IBM Technical Disclosure Bulletin vol. 21, No. 5, Oct. 1978 Digital Color Printer (D. W. Skinner and R. R. Schaffer).

IBM Technical Disclosure Bulletin vol. 22, No. 7, Dec. 1979 Multi-Color Printing (G. N. Baker and J. M. Dunn).

*Primary Examiner*—Eugene H. Eickholt

*Attorney, Agent, or Firm*—Lerner, David, Littenberg, Krumholz & Mentlik

[57] ABSTRACT

An apparatus for producing a multi-colored printing ribbon including a first printing station where one or more spaced transfer heads transfer a first color to selected portions of a web of base colored ribbon stock. A second printing station where one or more spaced transfer heads transfer a second color to said web interleaved with the first color to providing a serial, alternating color pattern. Control devices connected to both printing stations insure that the color segments are deposited in proper serial, spaced locations to prevent the colors from running onto each other. Also disclosed is a method for using such multi-colored ribbons to prevent counterfeiting or theft of various documents wherein at least some of the characters to be printed on such documents are printed in a predetermined sequence of colors.

24 Claims, 4 Drawing Sheets

APPARATUS FOR MAKING A MULTI-COLORED PRINTING RIBBON

BACKGROUND OF THE INVENTION

1. Field of the Invention

This invention relates generally to a method for preventing counterfeiting of sales slips, bank checks and other valuable and sensitive records and documents and more particularly to the apparatus for fabricating multi-colored printing ribbons suitable for use in business machines, printers and for retrofitting existing business machines for printing such records and documents in which the printing ribbon has segments of colors placed serially in an alternating and predetermined sequence along the longitudinal length of the printing ribbon transverse to the entire width of the web of the printing ribbons which are adapted for use in the said method for preventing counterfeiting and that of such records and documents.

2. Description of the Prior Art

It is well-known in the prior art that there are apparatus and methods for fabricating multi-colored printing ribbons having continuous lengths of at least two or more colored inks disposed side-by-side and parallel to each other along the entire length of the longitudinal axis of the web of the multi-colored printing ribbon. In the typical black-red two-colored printing ribbon, a length of black ink and a length of red ink deposited on the web of the printing ribbon each occupy approximately one-half of the entire longitudinal length of the web of the printing ribbon. In the use of such two-colored printing ribbons in any given business machine, the user can establish printed characters from such two-colored printing ribbons in black, in red or some combination of both.

U.S. Pat. No. 3,858,705 to Reitano shows a color-coded digit identifying ribbon for document fraud prevention in which the printing ribbon has parallel sections of colored inks extending along the longitudinal length of the ribbon in a ratio to each other to cover the entire width of the given printing ribbon. Conventionally, this printing ribbon is advanced in the direction of its longitudinal length and the impact business machine or other printers using such multi-color printing ribbon strike it transverse to the longitudinal direction of the movement of the printing ribbon. As a result, each column of characters or numbers can be in the same or in a different color and by comparing the printed color with the assigned color for that column, simple inspection of a record printed with such given ribbon, can tell whether the character or number is correct or has been altered. Because any error in the positioning of each character or the distortion of the color of the ribbon could create a possible error situation, it is essential that the depositing of each section or strip of colored ink on the ribbons being fabricated be very accurate and that no bleeding occur between adjacent colors.

U.S. Pat. No. 4,957,312 describes the existing need for controlling the counterfeiting of sales, bank checks and other valuable records and documents to prevent the use of such printed records for various fraudulent schemes to cheat retailers. Further, that while sophisticated printing equipment or specialized types of papers for such records or documents provides means and methods for overcoming this problem, the costs of such equipment to replace conventional printing equipment and the problems of obtaining cooperation with the suppliers of such specialized papers and the security entailed in preventing any theft of such specialized types of paper or unauthorized distribution of such paper presents additional problems which negative use of either of these solutions to the problem particularly by retailers who operate on low margins of profit.

Since most conventional business machines for producing such sales, bank check and other valuable records rely on impact printing in which a character is formed on a paper substrate as a result of the impact of the printing head upon an intermediate printing ribbon for transferring the impression, shape or alphanumeric characters on the printing head to the substrate paper, U.S. Pat. No. 4,957,312 describes a method of using a multi-colored printing ribbon which fits such conventional business machines or for retrofitting to existing business machines in the commercial marketplace to provide a cheap and easy technique adapted for overcoming this counterfeiting problem.

Thus U.S. Pat. No. 4,957,312 discloses the use of a multi-colored printing ribbon formed with two or more generally parallel lengths of longitudinally extending inked colors deposited along the longitudinally axis of the web of the printing ribbon and in the direction of travel of the ribbon to prevent counterfeiting of sales, bank checks and other important records in which the alphanumeric characters printed with such multi-colored printing ribbon will have at least an upper portion printed in one color while the lower portion is printed in a second color. If more than two colors are used, the central portion of the printed alphanumeric character may be in at least one additional color.

However, depending upon the colors and the coloring materials chosen for inking the printing ribbons made, for example, in accordance with U.S. Pat. No. 4,957,312, the resulting printed characters may be difficult to read or the colors when printed can run into each other which obscures the printed characters when such printing ribbons are used.

The present invention also overcomes the general counterfeiting problems in the commercial marketplace and the difficulties noted above with respect to prior art multi-colored printing ribbons for use with conventional business machines or printers by the method of equipping or retrofitting such business machines or printers with a multi-colored printing ribbon using serially disposed colored ink segments wherein the colored ink segments are arranged alternatively and in predetermined sequence transverse to the width of the longitudinal axis of the given printing ribbon. The alphanumeric characters on the printing head for printing with such improved multi-colored printing ribbons are arranged to strike the interposed intermediate printing ribbon so that the characters are generally in one of the colors of the segments and characters which are struck at the boundaries of a two adjacent colored ink segments may be made of two colors, one on the upper portion, another on the lower portion or with the left portion in one color and the right portion in another. By controlling the length of the colored ink segments deposited on the web of the printing ribbon and limiting the printing field all multi-colored characters may be eliminated or can be established at predetermined points along the line of printing formed by the business machine or printer.

SUMMARY AND OBJECTS OF THE INVENTION

Thus, the present invention provides an improved method for printing sales records, bank checks and other important or sensitive records or documents having a plurality of alphanumeric characters thereon in which different parts of at least some of said characters are printed in different colors from a printing ribbon, automatically advanced, during the printing of such records or documents, in the direction of the longitudinal axis of the printing ribbon wherein the printing ribbon has a plurality of segments of colored inks deposited alternately and in predetermined sequence serially along the longitudinal axis of the printing ribbon, transverse to the width of the web of the printing ribbon.

Additionally, the present invention covers apparatus having two or more ink color depositing stations for fabricating a multi-colored printing ribbon by passing the web of a printing ribbon made of any suitable material serially through the respective color depositing stations. By arranging spaced ink color depositing means at the first color depositing station spaced segments of a first ink color can be deposited on such web. Then, by advancing the partially colored web to the second ink color depositing station a second ink color can be deposited on said web at the locations left blank between the spaced ink segments deposited at the first color depositing station.

Additionally, the Apparatus as above defined having means for controlling the speed of the travel of the web of the printing ribbon, the spacing of the color depositing stations, and the offsetting of the rotation of the respective ink color depositing means at one or both of the ink color depositing stations, the ink colors can be properly and accurately deposited on the web of the printing ribbon in the desired sequence with minimal overlap or spacing between the color segments deposited on the web of the printing ribbon.

Accordingly, it is an object of the present invention to provide and improved method to prevent counterfeiting of sales, bank checks and other important and sensitive records and documents wherein different parts of the alphanumeric characters printed in such records or documents have different parts of at least some of the characters in different colors, It is another object of the present invention to provide an improved method for preventing counterfeiting of sales, bank checks and other important records and documents by printing the records and documents with an improved multi-colored printing ribbon having a plurality of segmented colors inked alternatively and in predetermined sequence along the longitudinal axis and transverse to the width of the web of the printed ribbon.

It is another object of the present invention to provide an improved apparatus and method for fabricating a multi-colored printing ribbon for use in the method for preventing the counterfeiting of sales, bank checks and other important and sensitive records and documents.

It is another object of the present invention to fabricate a multi-colored printing ribbon for use in and for retrofitting conventional business machines and printers in which a plurality of ink colored segments are arranged alternately and in predetermined sequence serially along the longitudinal axis of the printing ribbon and transverse to the width of the web defining the printing ribbon.

It is another object of this invention to provide an apparatus having multiple color depositing stations where one ink color is deposited along a web in spaced segments at a first station and at least one other ink color is deposited between the spaced segments of the first color at a second station.

It is a still further object of the invention to provide an apparatus for fabricating an improved multi-colored printing ribbon which apparatus has multiple color depositing stations wherein a plurality of spaced segments of a first color are deposited on the blank web of a printing ribbon with a color depositing device at a first ink color depositing station and a plurality of spaced segments of at least one other ink color are deposited with a color depositing device at a second color depositing station.

Other objects and features of the invention will be pointed out in the following description and claims and illustrated in the accompanying drawings, which disclose, by way of example, the principles of the invention, and the best mode which has been presently contemplated for carrying it out, as follows:

DESCRIPTION OF THE PREFERRED EMBODIMENT

Figure 1:
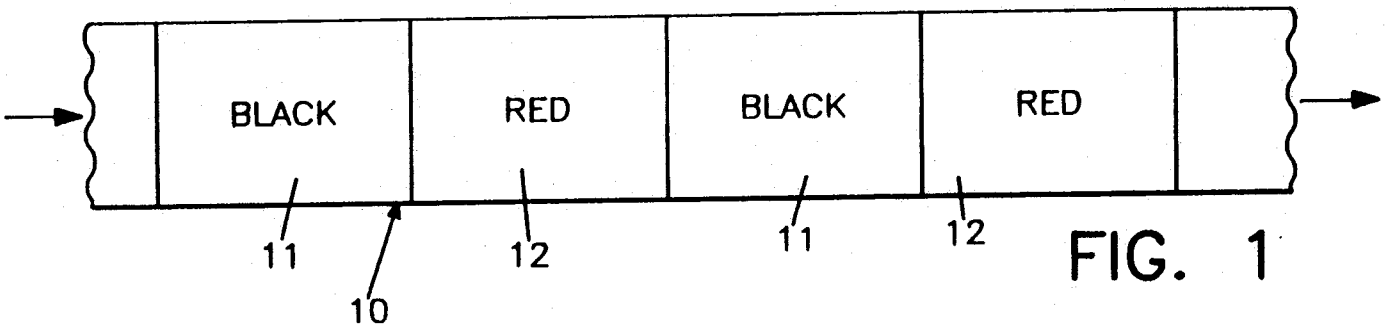
FIG. 1 is an enlarged fragmentary schematic top plan view of a multi-colored printing ribbon in accordance with the invention as disclosed herein.

In accordance with the method of the present invention for preventing counterfeiting of sales, bank check and other records and documents, the business machines or printers for printing such records and documents are equipped or retrofitted with an improved multi-colored printing ribbon, as more fully described hereinafter. Such improved multi-colored printing ribbons have deposited thereon at least two or more inked colors, alternatively and in predetermined sequence extending serially along the longitudinal length of the printing ribbon and disposed transverse to the width of the web of the given printing ribbon.

With such multi-colored printing ribbon the alphanumeric characters that is alphabet letters, geometric numbers, special symbols and the like, as well as combinations thereof which can be used to describe a transaction or other information, can be printed as the said printing ribbon is advanced in the direction of its longitudinal axis so that the alphanumeric characters are printed either in a solid color or the top half of the character, numeral or symbol can be in one color and the bottom half in another color or the left side of the character, numeral or symbol can be in one color and the right side in another color; the printing ribbon being so formed and positioned in the printing machine that it serves to establish the predetermined sequence in which the alphanumeric characters are printed.

The variety of the variations of the colors from printing ribbon to printing ribbon and the positioning or sequencing of the alphanumeric characters which are printed in one, two or more colors is endless and will be difficult to copy for most normal trade transaction to which the present invention relate and for which the present invention is particularly applicable.

Additionally, for further protection it is possible to deposit on the web of the printing ribbon materials or colors having a magnetic or florescent compounds so that the record or document printed with such printing ribbon could be more easily checked for authenticity. For example, if the improved multi-colored printing ribbon in accordance with the present invention is inked with a colored ink having a florescent material included therein, the printed record or document may reflect one color under natural light and a second color under a "black light" because of the response of the florescent material in one or more of the colors impregnated into the improved printing ribbon in accordance with the present invention.

All of the above is illustrated by reference to FIG. 1 of the drawings in which a sample or portion of an improved multi-colored printing ribbon in accordance with the invention and generally designated 10 has two different colored inks deposited thereon alternatively and in predetermined sequence serially along the longitudinal axis of the web of the printing ribbon, each of the alternate segments of the colors being disposed transverse to the width of the web. Thus the printing ribbon 10 can have colored inks deposited thereon such that color segments 11 will be black and color segments 12 will be red, and as shown, the segments will continue alternative in black and red the full longitudinal length of one printing ribbon, each transverse to the entire width of the web for the given printing ribbon.

Figure 2:
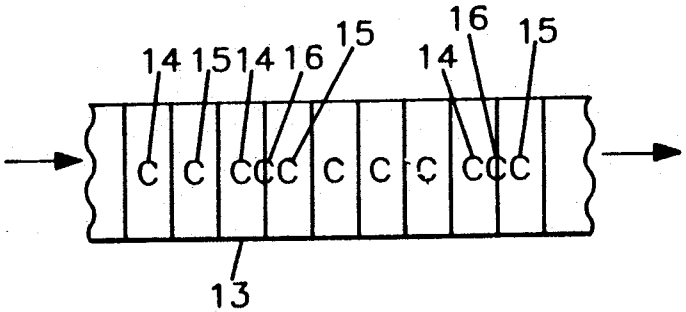
FIG. 2 is a fragmentary schematic top plan view showing a single line as printed on a multi-colored printing ribbon in accordance with the invention by a business machine or printer using such multi-colored printing ribbon in accordance with FIG. 1.

When a record or document is printed on a business machine or printer using such improved multi-colored printing ribbon, FIG. 2 shows a fragment or sample of how one such printed record 13 is printed on the ribbon in which the alphanumeric characters as at 14 printed from the colored ink segments 11 will be in black and the characters 15 printed from the colored ink segments 12 will be in red. By inserting intermediate alphanumeric characters as at 16 which are printed at the point on the ribbon where the respective black colored ink and red colored ink segments 11 and 12 abut with respect to each other, the alphanumeric character will print part in black and part in red in accordance with the predetermined sequence of black and red segments so that if anyone attempts to use a similar printing ribbon the difference in the alphanumeric characters will immediate show up from that set up for the particular printed record or document and thus disclose a counterfeit document or that efforts have been made to tamper with a genuine document.

Figure 3:
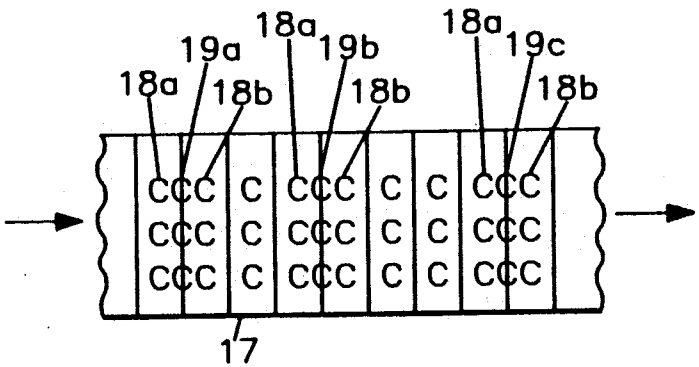
FIG. 3 is a fragmentary schematic top plan view showing multiple lines of printing on a multi-colored printing ribbon in accordance with the invention made by a printing machine or printer using a multi-colored printing ribbon having three colors instead of two.

While the explanation as illustrated in FIGS. 1 and 2 has been shown in simplified form by using a single printed line of alphanumeric characters, those skilled in the art will readily recognize that this concept is equally applicable to multiple lines of such characters and with ribbons have three or more colored ink segments thereon as is illustrated in FIG. 3 of the drawings.

Thus, by reference to FIG. 3, a multi-colored printing ribbon generally designated 17 is schematically illustrated which has been printed on a business machine or printer using an improved multi-colored printing ribbon in accordance with the present invention except that it differs from the one schematically illustrated in FIG. 1 and 2 above described, in that it will have three colors black, red and blue. In the printed record or document the alphanumeric characters as at 18 and 18*b* can for the most part be in black and red and this can be fixed by the predetermined sequence of black and red transverse segments for the given printing ribbon. In addition, however, certain of the alphanumeric characters as at 19*a*, 19*b* and 19*c* will be in a combination of the colors for example black and red, black and blue or red and black. Trying to counterfeit a record or document printed with such ribbon will be very difficult because the sequence of these colors can be varied from printing ribbon to printing ribbon used in the given business machine or printed for making the record or document.

Apparatus for Fabricating the Improved Multi-Colored Printing Ribbons

The Apparatus generally designated A for fabricating the improved multi-colored printing ribbon for accomplishing the method as above described is shown in FIGS. 4 to 9 of the drawings.

Figure 4:
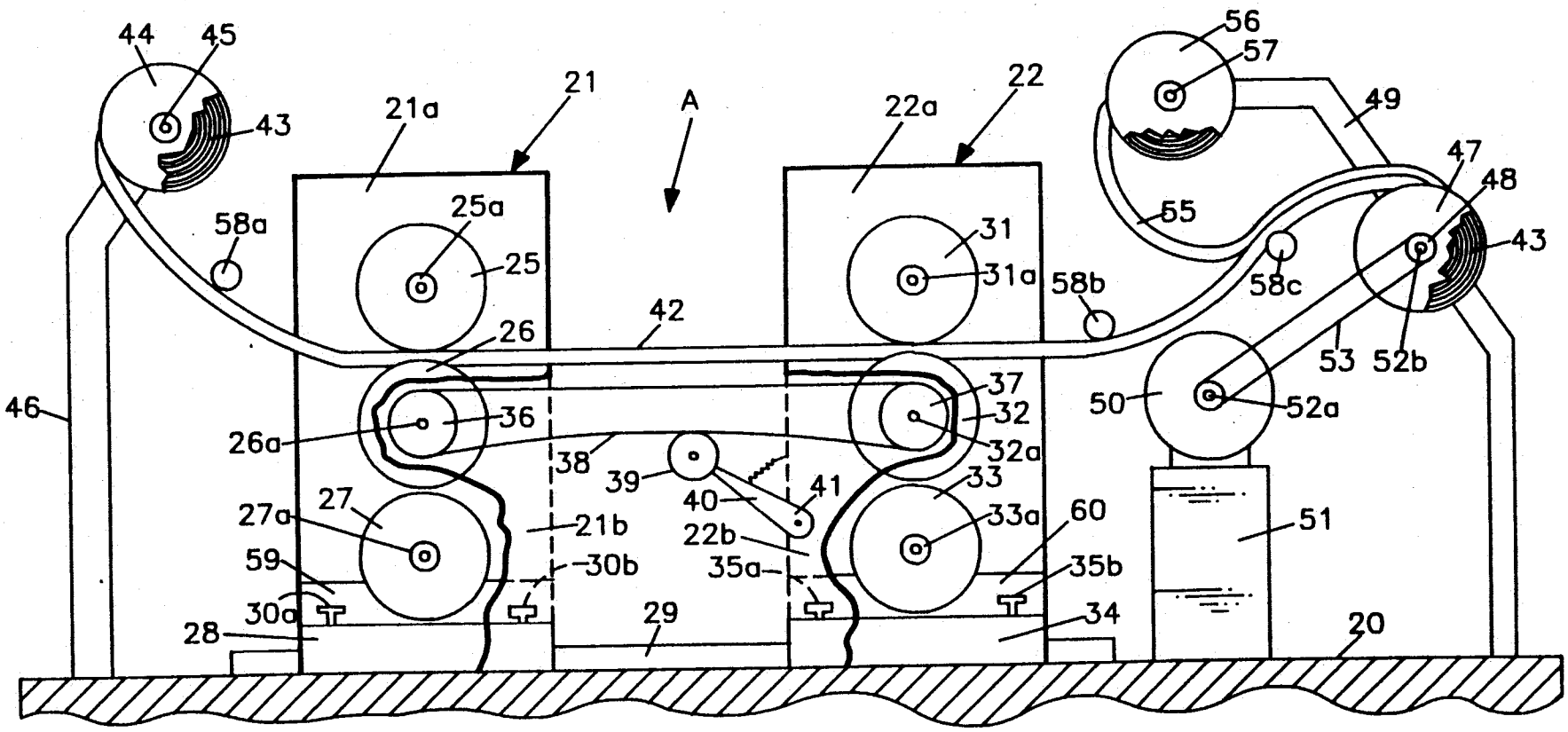
FIG. 4 is a side elevational schematic view of one preferred apparatus for the fabrication of a multi-colored printing ribbon in accordance with the invention.

FIG. 4 illustrates such Apparatus in schematic form as having a base generally designated 20 and a first ink depositing station generally designated 21 and a second ink depositing station generally designated 22. Each of the respective first and second ink depositing stations 21 and 22 having matching and spaced side frames 21*a*, 21*b*, 22*a* and 22*b* for supporting therebetween the parts and coacting elements of the first ink depositing station 21 and the second ink depositing station 22.

First, ink depositing station 21 includes, three rollers 25, 26 and 27 each mounted for rotation about an associated axle as at 25*a*, 26*a*, and 27*a* which are connected at one end to the side frame 21 and at the opposite end to the matching side frame 21*a*. The side frame 21*a* and its associated matching side frame 21*b* are connected in spaced relation to opposite sides of a block 28 which is slidably mounted on a rail 29 formed on the base 20. When the block 28 is adjustably positioned so as to space the first ink depositing station from the second ink depositing station threaded locking members as at 30*a* and 30*b* are provided to hold the block and the first ink depositing station 21 in the adjusted position.

Similarly, the second ink depositing station 22 includes three rollers 31, 32 and 33 each mounted for rotation about an associated axle as at 31*a*, 32*a* and 33*a* which are connected at one end to the side frame 22*a* and at the opposite end to the associated matching side frame 22*b*. The frame 22*a* and its associated matching side frame 22*b* are in turn connected in spaced relation to opposite sides of a block 34 which is also slidably mounted on the rail 29 formed on the base 20. When the block 34 is adjustably positioned so as to space the second ink depositing station from the first ink depositing station threaded locking members as at 35*a* and 35*b* are provided to hold the block 34 and the second ink depositing station 22 in the adjusted position.

Connected to one end of the axle 26*a* at the point where it extends through the associated matching side frame 21*b* concentric width the roller 26 is a first pulley 36. A second pulley 37 is connected to the end of the axle 32*a* where it extends through the associated matching side frame 22*b*, concentric with the roller 32. Pulleys 36 and 37 are connected for rotation by a timing belt 38 which is maintained at the proper tension depending on the relative spacing of the first ink depositing station 21 and the second ink depositing station 22 by a timing roller 39 mounted at one end of the spring biased timing arm 40 which is pivotally mounted as at 41 to the side frame 22*b*, all of which is shown in FIG. 4 of the drawings.

Those skilled in the art will recognize that suitable driving means, not shown, will be required to rotate the rollers 25, 26 and 27 of the first ink depositing stations and the rollers 31, 32 and 33 of the second ink depositing station, which driving means will also include conventional speed controlling means, to enable the colored ink to be deposited on web 42 of the printing ribbon 43 to be inked in accordance with the required inking colors for the given printing ribbon. However, specific adjustments to assure that the segments of the colors being deposited will not overlap or separate to form blank uncolored sections between such segments are accomplished by adjusting the spacing between the first ink depositing station 21 and second ink depositing station 22 as well as the timing belt for the pulleys 36 and 37, as is more fully described herein after.

FIG. 4 further shows the web 42 of the printing ribbon 43, to be inked is disposed to be fed into operative relation with the first ink depositing station 21 and second ink depositing station 22.

Such webs for printing ribbons may be made of cotton, rayon, nylon or may be made of non-woven material such as cotton or wool felt depending on the requirements for the particular machine or printer in which the printing ribbon will be used. Typically such webs are 0.79 mm in width, having a thickness of 0.01016 mm and come in convenient lengths such as 100 meters. Those skilled in the art will recognize that blank generally white printing ribbons of the type as above described are readily available on the open market and hence are not more fully described herein.

In order to feed the web 42 of the printing ribbon 43 into operative association with the first ink depositing station 21 and second ink depositing station 22, for deposition or impregnation of the colored inks or other material thereon, a supply spool 44 of the printing ribbon 43 is mounted for generally free rotation on an axle 45 disposed at one end of supporting arm 46 connected at its opposite end to the base 20, a spaced distance from the first ink depositing station 21. The end of the blank web 42 defining the printing ribbon 43 is passed serially between rollers 25 and 26 at the first ink depositing station 21, between rollers 31 and 32 of the second ink depositing station 22 and then to a take-up or pick-up spool 47 rotatably supported on pick-up spool axle 48 and connected medially along support arm 49, the lower end of which is connected to the base 20 a spaced distance from the second ink depositing station 22. A motor 50 mounted on a pedestal 51 formed on the base 20 is connected by pulleys 52*a* and 52*b* and a suitable driving belt 53 to the pick-up spool 47. The motor can be controlled, by any of a plurality of means as is well known in the art, to rotate the pick-up spool 47 so as to advance the web 42 of the printing ribbon 43 through the respective rollers 25 and 26 of the first pick-up station and rollers 31 and 32 of the second ink depositing station, at speeds within a range between 1016 mm to 2032 mm per minute and more generally at speeds of about 1372 mm per minute.

A further web 55 of protective material such as cloth or paper is fed from a supply spool 56 rotatably supported on axle 57 connected to the upper end of the pick-up support arm 49 outboard of the pick-up spool 47 so that it may rotate freely to deliver the web material 55 so as to interleave the web material between the successive turns of the web 42 of the printing ribbon as it is wound about the take-up or pick-up spool 47, to prevent print-through or bleeding of the colors or other material deposited on the web 42 of the printing ribbon 43 from one turn of the web 42 to an adjacent turn of the web, as it is wound upon the pick-up spool 47 during the ink depositing operation of the apparatus A for fabricating the improved multi-colored printing ribbon for use in the method for preventing counterfeiting and theft of records and documents in accordance with the present invention, all of which is shown in FIGS. 1, 2, 3 and 4 of the drawings.

FIG. 4 also shows that spaced guide rollers as at 58*a*, 58*b* and 58*c* are used to guide the path of the webs 42 and 55 as these webs are wound about the pick-up spool 47.

Figure 5:
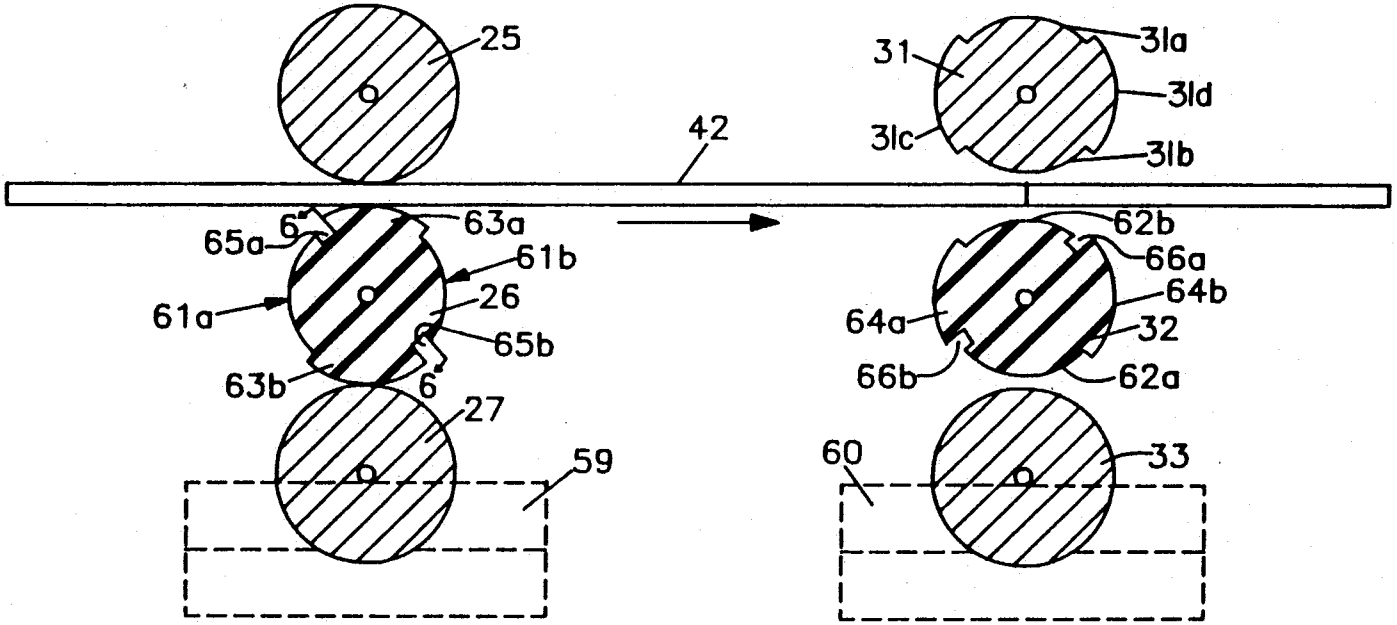
FIG. 5 is a side elevational schematic view of the color depositing stations of the apparatus shown in FIG. 4 with the color depositing rollers shown in cross-section.

Turning now to FIG. 5 which shows that the first and second ink deposition station 21 and 22 have their respective ink pick-up and delivery rollers 27 and 33 set in an associated tub or container as at 59 and 60 each respectively holding solutions of material such as colored inks or dyes or other materials to be deposited on the web 42 traveling through the respective first and second ink depositing stations 21 and 22.

Pick-up and delivery rollers 27 and 33 are preferably solid members and may be constructed from steel, rubber or other materials, to the outer surfaces of which, the solution material in the tubs 59 and 60 will readily adhere as the rollers 27 and 33 are rotated through these tubs.

Rollers 27 and 33 coact with depositing rollers 26 and 32 which have surface configurations thereon for forming the spaced segments of the inked colors, dyes or other material deposited on the web at the first ink depositing station 21 and second ink depositing station 22 of the Apparatus A for fabricating the multi-colored printing ribbon used in accordance with the method of the present invention as above described.

Figure 7:
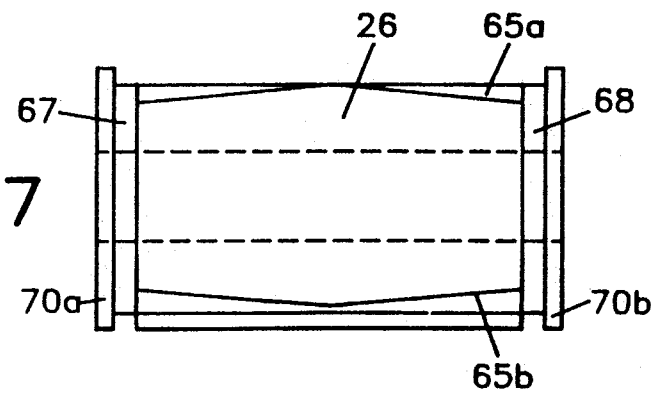
FIG. 7 is a front elevational view of the color depositing roller for the color depositing stations shown in FIG. 5.
Figure 6:
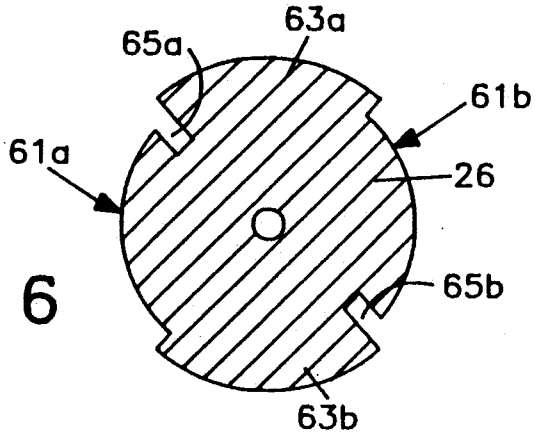
FIG. 6 is a cross-section of one form of color depositing roller taken along the line 6—6 of FIG. 5.

Thus, as shown in FIG. 5, 6 and 7 the depositing rollers 26 and 32 are formed by grinding and removing on each respective roller two oppositely spaced elongated depressions as at 61*a* and 61*b* on roller 26 and 62*a* and 62*b* on roller 32, leaving two spaced ink depositing lobes 63*a* and 63*b* on roller 26 and 64*a* and 64*b* on roller 32. During rotation of the rollers 27 and 26 at the first ink depositing station 21 when the lobes 63*a* and 63*b* come in contact with the outer surface of roller 27 the colored ink or other material from the associated tub 59 which adhered to the outer surface of lobes 63*a* and 63*b* of roller 27 will be transferred or coated onto the outer surface of the respective lobes 63a and 63b of the depositing roller 26. Similarly during rotation of the rollers 33 and 32 when the lobes 64a and 64b on the roller 32 come in contact with the outer surface of roller 33, the colored ink, dye or other material from the associated tub 60 which adhered to the outer surface of roller 33 will be transferred or coated onto the outer surface of the respective lobes 64a and 64b.

To insure that any excess coloring or other material transferred from the roller 27 to the respective faces of the lobes 63a and 63b on the roller 26 and from roller 32 to the respective faces of the lobes 64a and 64b on the roller 32, does not transfer to either the blank space between the respective colored segments or the differently colored or coated segments, created by the depressions 61a and 61b and lobes 63a and 63b on roller 26 or depression 62a or 62b and lobes 64a and 64b on roller 32, drainage grooves for the lobes on each of the rollers 26 and 32 are provided as at 65a and 65b for roller 26 and 66a and 66b for roller 32 all of which is shown at FIGS. 5, 6 and 7 of the drawings.

These drainage grooves 65a, 65b, 66a and 66b progressively increase in depth from the center of the rollers 26 and 32 to their respective sides where they communicate with common drains on the respective sides of the rollers 26 and 32, as at 67 and 68 for roller 26 as is shown in FIG. 7 of the drawings. Common drains, not shown, are also provided for roller 32 identical to those above described and shown for roller 26.

Platen roller 25 on the first ink depositing station 21 and platen roller 31 on the second ink depositing station 22 are each disposed on the side of the web 42 of the printing ribbon 43 opposite from the side of the respective rollers 26 and 32 for depositing the colored inks, dyes or other materials transferred or coated on the various lobes 62a, 62b, 64a and 64b as has been above described.

Platen or back-up rollers 25 and 31 are also solid rollers made of steel, hard rubber or the like materials and in assembled position act to back-up or to exert a counter force against the web 42 when the rollers 26 and 32 are rotated for the purpose of transferring the colored ink, dyes or other materials from the lobes 62a, 62b, 64a and 64b to the web 42.

Thus as shown in FIGS. 4 and 5 rollers 26 and 32 are position generally in abutment with the lower face of the moving web 42. In alignment with the centerline of rollers 26 and 32 but on the side of the web 42 opposite from these rollers are the back-up or counter force rollers 25 and 31. As the web 42 travels from the supply spool 44 between the rollers 26 and 25 at the first ink depositing station 21 the colored inks, dyes or other materials on the surfaces of lobes 63a and 63b will be deposited with spaced segments therebetween by reason of the cuts outs or depressions 61a and 61b on the roller 26 which deposit no color, no dyes or other material on the web 42.

As the web 42 is further advanced from the supply spool 44 to the pick-up spool 47 it now passes between the rollers 32 and 31 at the second ink depositing station. Roller 32 is disposed so that the lobes 64a and 64b will contact the lower face of the web 42 at a point or position offset about 90° from the point where the lobes 63a and 63b of the roller 26 contacted the web 42 to the extent that when the lobes 64a and 64b of the roller 32 transfer the colored ink, dyes or other materials it will be depositing them at the blank segments between the points on the web of the ribbon 42 where the roller 26 transferred the colored inks, dyes or other materials during the passage of the web 42 through the first ink depositing station 21. The relieved or depress sections 62a and 62b on the roller 32 prevent the roller from transferring or depositing any colored inks, dyes or other materials which are on these surfaces in the segments of the web which were already coated when the web 42 passed through the first ink depositing station 21.

In the illustrated form of the apparatus for forming a printing ribbon for use in the present invention, the lobes 63a, 63b, 64a and 64b are approximately the same length hence the segments of colored inks, dyes or other ingredients have approximately the same dimensions when transferred or deposited on the web 42 and are about 3.81 mm to 3.96 mm in length for rollers in the proportion as illustrated.

In the schematic view of the first and second ink depositing stations 21 and 22 as shown in FIG. 5 of the invention, the platen or back-up roller 31 differs from the platen or back-up rollers 25 to show that in order to obtain more accuracy or precision in the transfer of the colored inks, dyes or other materials from the depositing rollers 26 and 32 that the plates or back-up roller 32 can be formed by grinding, removing, forming or under cutting two oppositely spaced elongated depressions as at 31a and 31b, which leaves two oppositely spaced lobes as at 31c and 31d. By positioning these respective lobes 31c and 31d so they are disposed opposite the corresponding lobes 64a and 64b, and by providing suitable spacing between the coacting surfaces of lobes 31c and 31d on the roller 31 and 64a and 64b on the roller 32, rollers 32 and 31 can coact to establish a more accurate deposition of colored inks, dyes and other materials from the surface of the lobes 64a and 64b onto the spaced blank segments between the colored segments on the web 42 established after the web passes through the first ink depositing station 21. Those skilled in the art will readily recognize that the accurate deposition of the colored inks, dyes and other materials is material to the method of the present invention a above described and to the performance of the ribbons made in accordance with the present invention when used in such method.

Further, however, while the rollers are shown as having two lobes thereon, this is for the purpose of simplifying the illustration of the fabrication of the printing ribbon for use in accordance with the present invention. The number of lobes on any given set of rollers for the first and second ink depositing stations can be increased so as to create more but smaller dimensioned segments of colored inks, dyes or other materials without departing from the scope of the present invention.

In order to insure that the rollers 26 and 32 deposit or transfer properly size segments of the colored inks, dyes or other materials to the web 42, the first ink depositing station 21 and the second ink depositing station 22 can be adjusted for longitudinal movement towards and away from each other or by adjusting the timing belt 38. This is done empirically to prevent either overlap of the segments of color where the lobes engage the web to early or portions of blank segments appear on the web where the lobes engage the web to late.

As another factor in obtaining proper deposition of the colored inks, dyes and other materials it is necessary to control the amount of the inks, dyes and other materials deposited on the web 42 as has been above described. The amount of coloring material deposited for example will alter the apparent strength of the color, the opacity of the color, its reflectiveness and other factors. This can be accomplished by adjusting the spacing between the pick-up and delivery rollers 27 and 33 in their respective liquid tubs 59 and 60, the operatively associated inking rollers 26 and 32 with the respective delivery rollers 27 and 33 so as to control the amount of coloring or other material transferred from roller 27 to the lobes 63*a* and 63*b* on roller 26 and from roller 33 to the lobes 64*a* and 64*b* on the roller 32, and the operatively associated platen or back-up rollers 25 and 31 with the ink and the depositing rollers 26 and 32 including, modifying the surface configuration of the platen or back-up roller as at 31.

Figures 8, 9:
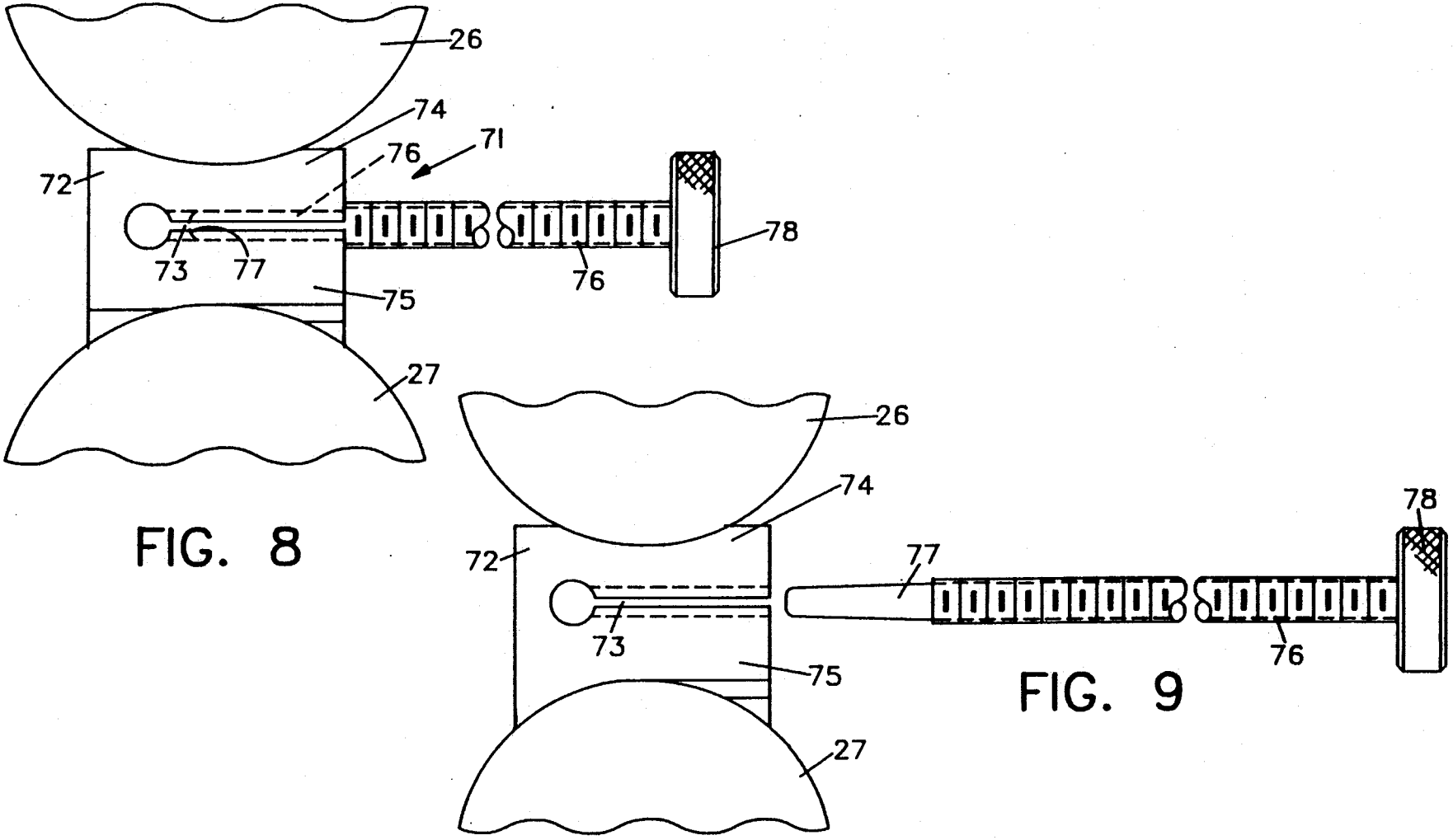
FIG. 8 is a fragmentary side elevational view, greatly enlarged, of one of the rollers of FIG. 5 with its associated roller adjustment device in assembled position for operative engagement of the associated roller.
FIG. 9 is an exploded side view of a greatly enlarged roller adjustment device used with the color depositing roller shown in FIGS. 5 and 8.

One means for accomplishing the initial spacing between the rollers of the ink depositing station is illustrated at FIGS. 7, 8 and 9 with reference to the rollers 25, 26 and 27 of the first ink depositing station 21. FIG. 7 shows that the roller 26 is provided with spaced rims as at 70*a* and 70*b*. These spaced rims serve to hold the rollers 25, 26 and 27 in spaced relation to each other.

Another way of controlling the spacing between the rollers 27 and 26 on the first ink depositing station 21 or rollers 33 and 32 of the second ink depositing station 22 is by means of an adjustable spacing assembly generally designated 71, one form of which is shown in FIGS. 8 and 9 of the drawings.

Adjustable spacing assembly 71 includes, an elongated generally rectangular body 72 which engages the rollers 26 and 37 or 32 and 33. Rectangular body 72 has a longitudinally extending slot as at 73 transverse to the length of the rectangular body 72 that forms an upper adjustment member 74 and a lower adjustment member 75. A threaded bore 76 is centered in the body 72 to threadably receive an adjustment screw 76 which has a tapered end section 77 at one end and a knurled head 78 at the opposite or external end of the adjustment screw to enable the adjustment screw 76*b* to be threaded to and fro in the threaded bore 76.

When the adjustment screw is threaded inwardly the rollers 26 and 27 are spaced away from each other. Conversely when the adjustment screw is threaded outwardly the rollers 26 and 27 are moved closer together. The same type of adjustable spacing assembly as thus described is also provided for roller 32 and 33 of the second ink depositing station 22. Suitable types of bearing and axle assemblies will be used to enable the rollers to be positioned as above described as will be understood by those skilled in the art.

One way of determining how much colored ink, dye or other material from the tubs 59 and 60 is being transferred, coated on or impregnated into the web 42 is to weight the printing ribbon 43 before the transfer of the colored ink, dye or other material and then to weight the printing ribbon after the web of the printing ribbon has been coated or impregnated with such colored inks, dyes or other materials taking into account the weight of the protective material of the protective web 55 interposed between the wound layers of web 42 of the printing ribbon 43.

The increase in weight for colored inks coated or impregnated into the web of the given printing ribbons will generally be in a range of 15% to 40% of the original weight of the printing ribbon and often about 25% of such weight. Thus, a 25% ribbon has 25% more weight due to the addition of the colored inks, dyes or other materials transferred, deposited coated or impregnated in or into the web 42 of the printing ribbon 43.

Operation

In order to fabricate the printing ribbon required for the method of printing a record designed to overcome the problems of counterfeiting and theft of sales, bank checks and other important records and documents, the apparatus A as above described will first have the blank web 42 of the printing ribbon 43 passed from the supply spool 44 on which the printing ribbon is mounted between the rollers 25 and 26 at the first ink depositing station 21 and rollers 31 and 32 of the second ink depositing station 22 and then onto the pick up spool 47 where the end is fastened along with the end of web 55. When the pick up spool 47 is rotated by the motor 50 the web 42 will automatically be drawn through the rollers 25 and 26 and rollers 31 and 32 at the respective first and second ink depositing stations 21 and 22 and then wound together with web 55 on the pick-up spool 47.

The motor 50 can now be placed in operation together with the driving means, not shown, for the rollers 26 and 27 of the first ink depositing station and the rollers 32 and 33 of the second ink depositing station. The respective colored inks, dyes or other materials contained in the respective tubs or containers 59 and 60 will be deposited on the lobes of the rollers 26 and 32 and then onto the web 42 a above described.

A few feet of the web is first run to determine how the various segments of the colored inks, dyes or other materials in the tubs or containers 59 and 60 are being deposited on the web 42. From this initial test information the first ink depositing station 21 and second ink depositing station 22 and the timing belt 38 can each be adjusted to correct any overlap or improper spacing between the segments deposited on the web 42 as also has been above described.

By weighing a portion of the web it is also possible to determine the thickness of the coating of colored inks, dyes or other materials being deposited on the web 42 of the printing ribbon 43 and the adjustable spacing assemblies 71 for the respective first ink depositing station and second ink depositing station are then adjusted to provide the optimum transfer, coating or impregnation desired.

Thereafter the apparatus A can be continued until the entire web of the printing ribbon has been coated or impregnated with the required quantity of colored inks, dyes or other materials at which time the driving means for the rollers on the first ink depositing station 21 and second ink depositing station 22 is stopped and thereafter the motor 50 is also stopped so the supply spool 44 and pick-up spool 47 can be removed from the apparatus A and a new spool of printing ribbon mounted in position and the web threaded all as above described to a new pick-up spool 57 so that a new fresh blank printing ribbon 43 can be again coated or impregnated with the required colored inks, dyes or other materials for each given ribbon.

Thus, a method for preventing counterfeiting of sales, bank checks and other records and documents has been described together with the apparatus for fabricating the printing ribbon used in connection with the business machines and printers for printing up such records and documents.

It will be understood that the invention is not to be limited to the specific construction or arrangement of parts shown but that they may be widely modified within the invention defined by the claims which now follow.

What is claimed is:

1. Apparatus for making a two color impact printing ribbon which can transfer a color from said ribbon upon impact by a printing device hammer from a continuous web of base colored ribbon stock, said colors occurring in predetermined sequential segments of alternating colors, each segment of color extending across the entire width of said web transverse to the direction of advance of said web through said apparatus comprising:

a) a first color depositing station for depositing two spaced segments of a first color on said web, said first color permeating said web;

b) a second color depositing station for depositing two spaced segment of a second color on said web, said second color permeating said web;

c) means to advance said web sequentially through said first and said second color depositing stations; and d) control means operatively connected to said first and said second color depositing stations to control the depositing of said segments of said second color on said web so that a first of said two spaced apart segments of said second color is between said two segments of said first color and the second of said segments of said second color follows the second of said segments of said first color, said first and said second color segments being adjacent to but not overlapping adjacent color segments.

2. An apparatus as defined in claim 1, wherein said first color depositing station includes, two rollers each having a generally cylindrical periphery and mounted for rotation upon its own parallel and spaced axis so that the peripheral surfaces of said rollers move adjacent one another and engage the opposite surfaces of said web positioned between the adjacent peripheral surfaces of said two rollers; a first of said two rollers having a continuous peripheral surface to act as a back-up roller; the second of said two rollers having a peripheral surface comprised of at least two alternating raised lobes and depressed segments so that when a first lobe segment is in contact with said web a first segment of said first color is deposited upon said web and when a second lobe segment is in contact with said web a second segment of said first color is deposited upon said web and when a first or second depressed segment is adjacent said web no color is deposited upon said web.

3. An apparatus as defined in claim 2, wherein there are at least three alternating raised lobes and depressed segments to deposit three segments of said first color upon said web.

4. An apparatus as defined in claim 2, wherein said first of said two rollers is made of a solid material, and said second of said two rollers is made of a rubber-like compound.

5. An apparatus as defined in claim 2, wherein said second color depositing station is composed of two rollers each having a generally cylindrical periphery and mounted for rotation upon its own parallel and spaced axis so that the peripherical surfaces of said rollers move adjacent one another and engage the opposite surfaces of said web positioned between the adjacent peripheral surfaces of said two rollers; a first of said two rollers of said second color depositing station having a continuous peripheral surface to act as a back-up roller; the second of said two rollers of said second color depositing station having a peripheral surface composed of at least two alternating raised lobes and depressed segments so that when a first lobe is in contact with said web a first segment of said second color is deposited upon said web and when a second lobe is in contact with said web a second segment of said second color is deposited upon said web and when a first or second depressed segment is adjacent said web no color is deposited upon said web.

6. An apparatus as defined in claim 5, wherein said second roller of said second color depositing station is offset with respect to said second roller of said first color depositing station so that said segments of said second color are deposited upon said web in positions between the segments of said first color.

7. An apparatus as defined in claim 5, wherein there are at least three alternating raised lobes and depressed segments on said second of said two rollers of said second color depositing station and said second of said two rollers of said second color depositing station is offset with respect to said second roller of said first color depositing station so that said segments of said second color are deposited upon said web in positions between segments of said first color.

8. An apparatus as defined in claim 2, further including, means to apply coloring material of a first color to the surface of said second of said two rollers of said first color depositing station.

9. An apparatus as defined in claim 8, further including, adjustment means to control the amount of coloring material of a first color applied to said web by said second roller of said first color depositing station.

10. An apparatus as defined in claim 5, further including, means to apply coloring material of a second color to the surface of said second of said two rollers of said second color depositing station.

11. An apparatus as defined in claim 10, further including, adjustment means to control the amount of coloring material of a second color applied to said web by said second roller of said second color depositing station.

12. An apparatus as defined in claim 5, further including first means to apply coloring material of a first color to the surface of said second of said two rollers of said first color depositing station; and second means to apply coloring material of a second color to the surface of said second of said two rollers of said second color depositing station.

13. An apparatus as defined in claim 12, further including first adjustment means to control the amount of coloring material of a first color applied to said web by said second roller of said first color depositing station; and second adjustment means to control the amount of coloring material of a second color applied to said web by said second roller of said second color depositing station.

14. An apparatus as defined in claim 9, wherein said adjustment means is connected between said first and said second rollers of said first color depositing station to vary the spacing between said roller peripheries and thereby control the amount of coloring material of a first color transferred from said second roller to said web.

15. An apparatus as defined in claim 11, wherein said adjustment means is connected between said first and said second rollers of said second color depositing station to vary the spacing between said roller peripheries and thereby control the amount of coloring material of a second color transferred from said second roller to said web.

16. An apparatus as defined in claim 12, wherein said first adjustment means is connected between said first and said second rollers of said first color depositing station to vary the spacing between said roller peripheries and thereby control the amount of coloring material of a first color transferred from said second roller of said first color depositing station to said web; and said second adjustment means is connected between said first and said second rollers of said second color depositing station to vary the spacing between said roller peripheries and thereby control the amount of coloring material of a second color transferred from said second roller of said second color depositing station to said web.

17. An apparatus as defined in claim 1, wherein said means to advance said web sequentially through said first and second color depositing stations is a take-up spool, drive means for rotating said take-up spool, and said web is unreeled from a supply reel for such web.

18. An apparatus as defined in claim 17, further including, a reel of protective web material placed between layers of said web as the web is wound upon said take-up spool to space the turns of the web from each other upon the take-up spool to prevent the unwanted transfer of coloring material between adjacent layers of the web are wound on the take-up spool.

19. An apparatus as defined in claim 2, wherein the second of said two rollers of said first color depositing station further comprises a transverse groove between one edge of each raised lobe and the adjacent edge of each depressed segment to provide a run-off for any coloring material freed from its associated raised lobe and not transferred to said web.

20. An apparatus as defined in claim 19, wherein each of said transverse groove has a shallow central portion which extends outwardly towards the roller ends and increases in depth as it approaches the roller ends.

21. An apparatus as defined in claim 5, wherein the second of said two rollers of said second color depositing station further comprises a recess between the trailing edge of each raised segment and the leading edge of each depressed segment to provide a runoff for any coloring material freed from its associated raised segment and not transferred to said web.

22. An apparatus as defined in claim 21, wherein each of said recesses has a shallow central portion which extends outwardly towards the roller ends and increases in depth as it approaches the roller ends.

23. An apparatus as defined in claim 5, wherein each of the second of said two rollers of said first and second color depositing stations further comprises a recess between the trailing edge of each raised segment and the leading edge of each depressed segment to provide a run-off for any coloring material freed from its associated raised segment and not transferred to said web.

24. An apparatus as defined in claim 23, wherein each of said recesses has a shallow central portion which extends outwardly towards the roller ends and increases in depth as it approaches the roller ends, and a common drain at the sides of recess and for pouring any run-off for the coloring material to back to the reservoirs for such coloring material associated with the given roller.

* * * * *